United States Patent [19]

Dodonov et al.

[11] 4,274,032

[45] Jun. 16, 1981

[54] HIGH POWER LIQUID COOLED DOUBLE STRAPPED VANE TYPE MAGETRON

[76] Inventors: Jury I. Dodonov, Profsojuznaya ulitsa, 93, korpus 2, kv. 384, Moscow; Valentina F. Obidina, poselok Mosrentgen, 6, kv. 35., Moskovskaya oblast, both of U.S.S.R.

[21] Appl. No.: 55,441

[22] Filed: Jul. 6, 1979

[51] Int. Cl.[3] ..... H01J 25/50

[52] U.S. Cl. ..... 315/39.51; 313/17; 313/32; 313/39; 315/39.69; 315/39.75

[58] Field of Search ..... 313/17, 30, 31, 32, 313/37, 39; 315/39.51, 39.75, 39.69, 39.77

[56] References Cited

U.S. PATENT DOCUMENTS

| | | | |
|---|---|---|---|
| 2,480,999 | 9/1949 | Brown et al. | 313/32 X |
| 2,523,049 | 9/1950 | Nelson | 313/32 X |
| 2,678,407 | 5/1954 | Brown et al. | 313/32 X |
| 2,805,361 | 9/1957 | Brown | 313/32 X |
| 4,028,583 | 6/1977 | Bigham | 313/32 |

*Primary Examiner*—Saxfield Chatmon, Jr.
*Attorney, Agent, or Firm*—Burgess, Ryan and Wayne

[57] ABSTRACT

A microwave device of the magnetron type comprises an anode block with straps which are located with respect to one another along the axis of the block and are electrically connected to respective vanes of resonators of the block, these vanes having like polarity at the $\pi$-mode of oscillations. The anode block is provided with cooling channels adapted to cool the vanes of the resonators and straps, said channels communicating with at least one chamber designed to distribute a liquid coolant and with at least one chamber designed to collect the liquid coolant, said chambers being rigidly connected with the anode block and provided with a hydraulic coupling between them. The straps of the anode block are implemented in the form of ring-like tubes. At least four vanes, connected with the corresponding ring-like tubes, are provided, each, with radially extending channels equal in number to the ring-like tubes which are connected with these vanes, the channels each communicating with a respective one of the ring-like tubes and serving together with the tubes as the cooling channels for respective vanes and straps. One of the radially extending channels, communicating with a respective ring-like tube, also has a communication with the coolant distribution chamber, while another radially extending channel communicates with the coolant collection chamber. The chambers are located along the axis of the anode block and each has a length, as measured in the direction of that axis, equal to at least a space between two outermost radially extending channels which communicate with respective chambers.

2 Claims, 3 Drawing Figures

HIGH POWER LIQUID COOLED DOUBLE STRAPPED VANE TYPE MAGETRON

FIELD OF THE INVENTION

The invention relates to microwave devices, and more particularly, to microwave devices of the magnetron type.

The device of the invention is suitable for radar applications, for industrial electronics, for microwave heaters dealing, for example, with the heating of plasma and with the thermonuclear synthesis, which provides a means of obtaining new fuels.

DESCRIPTION OF THE PRIOR ART

At present, the specialists dealing with powerful microwave electronic devices tend to increase the continuous power output in the case of microwave oscillations generated by a single device. A microwave electronic device operates to convert the energy produced by a d.c. source to the energy of microwave oscillations with the help of electron beams emitted by the cathode and the electrodynamic system of the anode. In the microwave device of the magnetron type, the anode structure is often implemented as a chain of series-connected resonators which constitute a retardation system of a cylindrical anode block. This system is usually referred to as an anode block. The power output of a microwave device and of a microwave device of the magnetron type, in particular, is limited by the following factors: the materials of the anode, cathode and dielectric window for the power output; the ability of these materials to resist and scatter electric and heat loads; the electric efficiency of the device.

At present, the above-mentioned disadvantages are overcome as follows: the electronic efficiency is increased; special materials with higher emission characteristics are used for cathodes; materials having higher electrical and thermal conductivity are used for cathodes and anodes; materials resisting maximum permissible heat loads are used for anodes; and materials having smaller dielectric loss and higher transmission in the case of microwave power are used for energy output windows. The continuous (and average) power output provided by a single device can also be increased by introducing new design features. The latter ensure more effective cooling of the electrode surfaces subject to considerable heat loads. For example, use may be made of cooling systems utilizing turbulent movement of liquid coolants, cooling systems based on the evaporation method, and systems with heat-carrying tubing.

In a commercial microwave device of the magnetron type the anode block is affected by heat available from a number of heat sources as follows: the surface of the incandescent cathode; the surfaces of the vanes of the anode block, subject to electron bombardment; the surfaces of the resonators, passing r.f. currents.

The excessive heating of the anode block results in a deformation of the vanes and straps of the retardation system and, therefore, in a variation of the generated wavelength, in an increase in the resistive loss in the resonators and, finally, in a decrease in the efficiency of the device, as the intrinsic quality Q of the oscillatory circuit is decreased.

The heat from the heat-loaded parts of the device is transformed by conduction, convention and radiation and the heat flow Q is determined by $$Q=cS\Delta T \quad (1)$$

or $$q=c\Delta T, \quad (2)$$

where

Q is the heat flow (power dissipated);

$q=Q/S$ is the surface density of the heat flow;

S is the surface involved in the heat exchange;

$\Delta T=T_j-T_i$ is the temperature difference;

$T_j$ is the temperature of the surface (the heated area of the body);

$T_i$ is the ambient temperature;

c is the proportionality factor characteristic of the intensity of heat exchange.

At present, the heat-loaded parts of the anode block of a microwave device of the magnetron type are cooled by virtue of the forced convective transfer of heat utilizing liquid coolants of which water is the most frequently used. To increase the heat exchange by convection, the cooling system of the device is designed so that the most effective heat transfer is attained when a fluid is subject to turbulent movement or in the case of two-phase media (during boiling and condensation). In this case, the most difficult problem is concerned with the development of the cooling systems for the heat-loaded areas of a microwave device having a surface density of the dissipated power exceeding 500 W/cm$^2$. This is due to the fact that the heat-loaded parts of the anode block of a microwave device of the magnetron type, especially the vanes, start to melt. To provide for effective heat removal in superhigh-power microwave devices of the magnetron type, it is necessary, in the case of the forced fluid-type cooling, to have a well-branched system of channels designed to deliver and withdraw a liquid coolant, which system should offer prolonged operational reliability. With such channels, the liquid coolant can be consumed at a rate of several hundred liters per minute with pressure drops reaching several tenths of MPa (tens of atmosphere) so as to provide a speed of flow of the coolant of 3 to 5 m/sec and more. The working surface of the anode block has a very complex configuration and is implemented, in the case of magnetron generators, as a periodic structure of opposing pins or a vane-type structure of resonators with straps which are used to electrically connect said vanes in a certain sequence. As a result, critical limitations relating to the design and technological features are placed on effective cooling systems.

The most difficult problem involved relates to the development of a system of cooling channels which would have a small hydrodynamic resistance, as their greatest diameter, which can be realized in the anode block, does not usually exceed 4 to 6 mm with the length of the surface to be cooled, in the case of the vanes, exceeding by several hundreds of times the channel diameter. This especially applies to the powerful microwave devices of the magnetron type which have its anode block implemented as a multistage two-dimensional periodic retardation system which has a height, as related to the axis of the anode block, commensurate with the wavelength of the generated rated oscillations (0.5–1.5 times the wavelength and more).

Another critical problem related to the cooling of microwave devices of the magnetron type relates to a condition, most frequently encountered in such devices, in which the cooled areas of the surface of the anode block are subject to intense electron bombardment at the high value of the anode potential and of the r.f. potential. In this case, the working surfaces of the electrodes, vanes and straps are often subject to electric breakdown which causes the application of an additional local intermittent heat load to certain areas of the cooling system, which exceeds the statically applied heat by ten or a hundred times. In this case, the most adverse effects are related to the secondary electron charge developed between the surfaces held at an r.f. potential, namely, between the vanes of the resonators, between the vanes and straps of the resonators and the like, and thus developed within the retardation system itself.

Known in the art is a microwave device of the magnetron type, comprising an anode block with peripheral cooling, of the air- or liquid-type, and with a length greater than a quarter wavelength ($>\lambda/4$). The anode block is implemented as a multistage retardation system with straps, the latter being located with respect to one another, along the height of the system, at a distance less than a sixth of the operating wavelength (cf. U.S. Pat. No. 2,649,556 cl. 315-40 issued May 13, 1950 or U.S. Pat. No. 3,045,147 cl. 315-39.69 issued Nov. 16, 1959).

In the described device, it is impossible to effectively cool down the working surfaces of the anode block, namely, those portions of the vanes which are subject to the greatest effect of heat and are located in the vicinity of the cathode. The heated cathode and the electrons, which bombard the end faces of the vanes, provide for considerably greater power dissipation on the surface. As a result, the degree of cooling at the periphery of the anode block may be insufficient, especially in the case of continuous generation of microwave power. Therefore, the device fails to obtain a continuous or average microwave power of great magnitude.

There is another microwave device of the magnetron type, comprising an anode block with straps which are located with respect to one another along the axis of the block and are electrically connected to respective vanes of the resonators of the anode block, said vanes having like polarity at the $\pi$-mode of oscillations, and also comprising cooling channels designed to cool down the vanes, resonators and straps, said channels communicating with at least one chamber adapted to distribute a liquid coolant and with a chamber adapted to collect the liquid coolant, said chambers being rigidly coupled to the anode block and being hydraulically coupled with each other (cf. Journal of Microwave Power, 10(2), 1975, C. B. Bighom and M. Viant "High Power Industrial Heating Magnetron", pp. 233–244).

In this device, those areas of the working surface of the anode block, which are subject to the greatest heat, namely, the vanes of the resonators, are cooled down by means of the channels made as tubes affixed to the end faces of the vanes. These tubes are located along the overall length of the working surface of the vanes in parallel relation to the axis of the anode block.

Since the diameter (cross-section) of the channels is limited by the thickness of the walls of the vanes, an increase in the height of the anode block, necessitated by an increase in the device power, causes an increase in the length of the vanes and, therefore, in the length of the cooling channels, with the result that the hydrodynamic resistance of the channels is increased. As a result, the gauge pressure at the input of the cooling system (at the input of the coolant distribution chamber) must be increased. Therefore, with a low gauge pressure in the described device, the speed of flow of the liquid coolant, with which the heat loads are removed, is not attained, and the device fails to operate.

An increase of the gauge pressure above the rated value is limited by the circulation pump which provides for the transfer of the liquid coolant. In addition, the parameters of the cooling system of the device, which could withstand higher pressures, are dependent on the strength of the tube material (usually copper). A maximal pressure to which the tubes may be subject in commercial models does not exceed 10–20 atm.

In the known device, the tubes (or cooling channels) pass in close proximity to the interaction space whose boundaries are defined by the cathode and the end faces of the vanes. This results in a condition in which the walls of the tubes may melt since they are not shielded from the effect of heat and are subject to electron bombardment and breakdown within the cathode-anode space, with the result that the device may fail. Another failure is a result of clogging any one of the tubes. In this case, the reliability and service life of the device are affected, especially in the case of dirty coolant and prolonged operation.

In the known device, especially in the case of shortwave frequency range, it is impossible to fix the tubes to the end faces of the vanes, as the latter have small cross-section which is thinner than the permissible tube diameter.

SUMMARY OF THE INVENTION

An object of the invention is to provide a microwave device of the magnetron type, wherein a cooling system comprises channels adapted to cool down the vanes of the anode block and straps, said channel having a decreased hydrodynamic resistance and said cooling system offering higher effectiveness and reliability.

There is provided a microwave device of the magnetron type, comprising an anode block with straps which are located with respect to one another along the axis of the block and are electrically connected to respective vanes of resonators of the anode block, the vanes having the like polarity at the $\pi$-mode of oscillations, the anode block being provided with cooling channels adapted to cool down the vanes and of the resonators and the straps, said cooling channels communicating with at least one chamber designed to distribute a liquid coolant and with at least one chamber designed to collect the liquid coolant, said chambers being rigidly connected with the anode block and provided with a hydraulic coupling between them, in which device, according to the invention, the straps are implemented in the form of ring-like tubes, at least four vanes, connected with the corresponding ring-like tubes, being provided, each, with radially extending channels equal in number to the ring-like tubes which are connected thereto, the radially extending channels each communicating with a respective one of the ring-like tubes and serving together with the tubes as the cooling channels for respective vanes and straps, one of the radially extending channels, communicating with a respective ring-like tube, also having a communication with the coolant distribution chamber, another one of the radially extending channels, communicating with the coolant collection chamber, the both chambers extending along the axis of the anode block and each having its length, as measured in the direction of that axis, equal to at least a space between two outermost radially extending channels which communicate with respective chambers.

It is advantageous that one of the chambers is located in axial relationship to the anode block and arranged to surround the latter and the remaining one of the chambers.

The device of the invention has a well-branched cooling system designed to cool down the vanes of the resonators and straps of the anode block, said channels having smaller hydrodynamic resistance, and the system itself offering higher effectiveness and reliability. A considerably greater microwave power output is attained in the continuous and the pulsed mode of operation of the device.

A well-devised and highly branched system of channels, designed to forcedly cool down the vanes of the resonators and the straps of the anode block with a liquid coolant, makes it possible to use, on a maximal basis, the heat-loaded surface of the anode block so as to remove heat by means of the liquid coolant, and to provide for effective turbulent-type convective transfer of heat at a small pressure drop referred to the input and the output of the cooling system.

Since the channels in the straps are connected in parallel, thereby providing for the cooling of the vanes of the resonators and the straps themselves, the device of the invention operates reliably under very severe conditions, including power overloads, electric breakdowns, failure of one of the cooling channels, or insufficiently clean coolant.

DESCRIPTION OF THE INVENTION

The invention will now be described in more detail, by way of example, with reference to the accompanying drawings in which.

Figure 1:
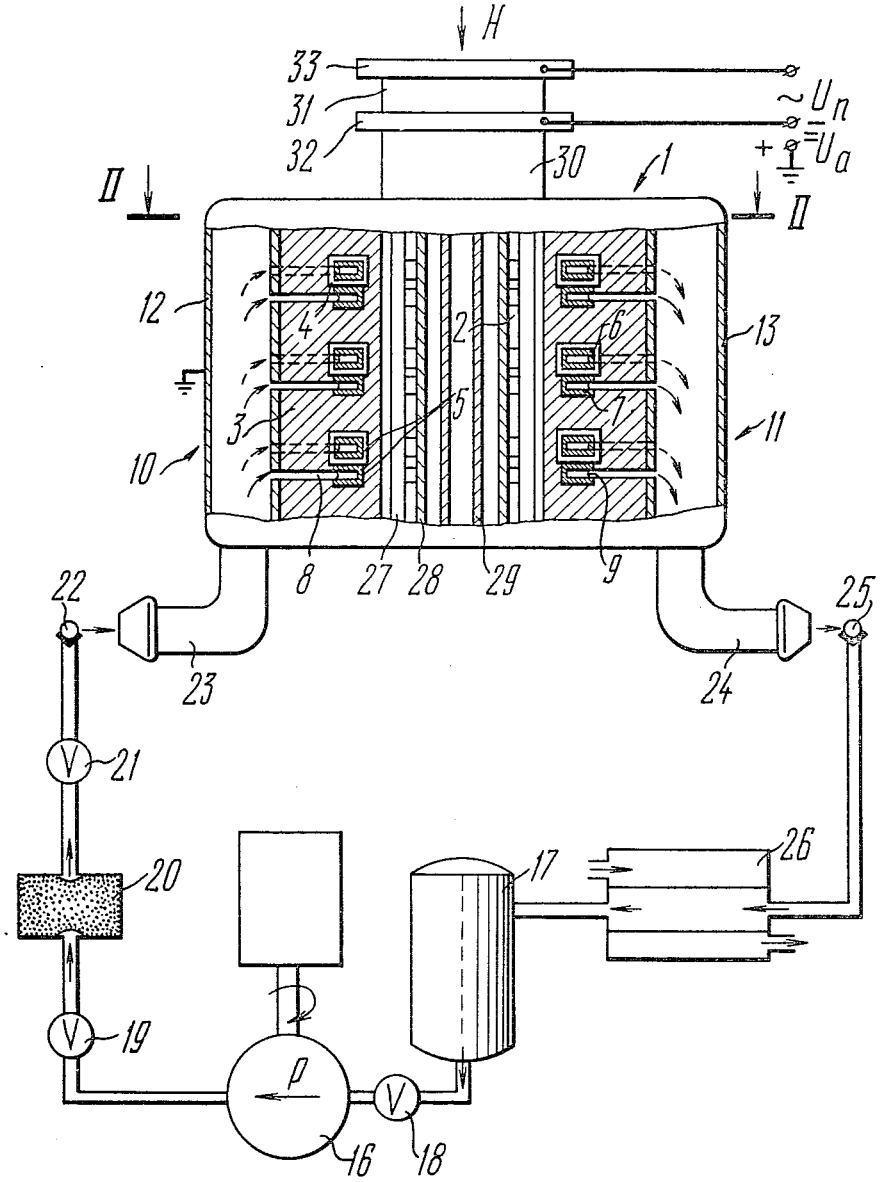
FIG. 1 is a partial longitudinal section of an anode block of a microwave device of the magnetron type with a system of channels adapted to cool down the vanes of the resonators and the straps of the anode block, a connection diagram for a.c. and d.c. power supplies being shown, and a variant of a schematic of a forced cooling system utilizing a liquid coolant being illustrated.

The device of the invention is described by using an example of a magnetron generator which is referred to as a magnetron in this text. The magnetron comprises an evacuated cylindrical anode block 1 (FIG. 1) implemented as a multistage resonance-type retardation system with segment-type resonators 2 having vanes 3. The latter, as viewed in height of the anode block 1, have windows 4 each of which passes straps 6, 7 arranged in strap pairs 5. The straps 6 of each strap pair 5 are electrically connected to respective vanes 3 of the resonators 2 of the anode block 1, said vanes 3 having the like polarity at the $\pi$-mode of oscillations. On the other hand, the straps 7 of each strap pair 5 are electrically connected to the corresponding vanes 3 of the resonators 2, said vanes 3 having the polarity opposite to that of the first-mentioned vanes 3 at the $\pi$-mode of oscillations. Note that FIG. 1 shows only the connection relating to the straps 7. The straps 6, 7 are made in the form of ring-like tubes which have a rectangular cross-section in the given embodiment. However, the tubes may be given any desirable shape, depending on the electrical and thermal characteristics of the device of the invention. The straps 6, 7 are provided with good thermal contact with the vanes 3 at the connection points, which is attained, for example, by soldering.

At least four of the vanes 3, connected with respective ring-like tubes, are provided, each, with radially extending channels equal in number to the ring-like tubes which are connected with a respective vane 3, each of said radially extending channels 8 being connected with a respective ring-like tube. In the given embodiment, the radially extending channels 8 (FIG. 2) are implemented in four vanes 3 which are arranged in two diametrically opposite pairs. The radially extending channels 8 in each vane 3 are equal in number to the ring-like tubes which are connected electrically and thermally to that vane 3. Each ring-like tube has in its end faces of the greater diameter two diametrically opposite holes 9 which provide a means of communicating two radially extending channels 8 with the cavity of that ring-like tube.

The radially extending channels 8 constitute together with the cavities of respective ring-like tubes the cooling channels for respective vanes 3 and straps 6, 7 (FIG. 1).

The radially extending channels 8 made in the vanes 3 of one of the two diametrically opposite pairs communicate with at least one chamber adapted to distribute the liquid coolant and labelled by reference numeral 10 in the given embodiment. The radially extending channels 8 of the other pair communicate with at least one chamber adapted to collect the liquid coolant and labelled by reference number 11 in the given embodiment.

Figure 2:
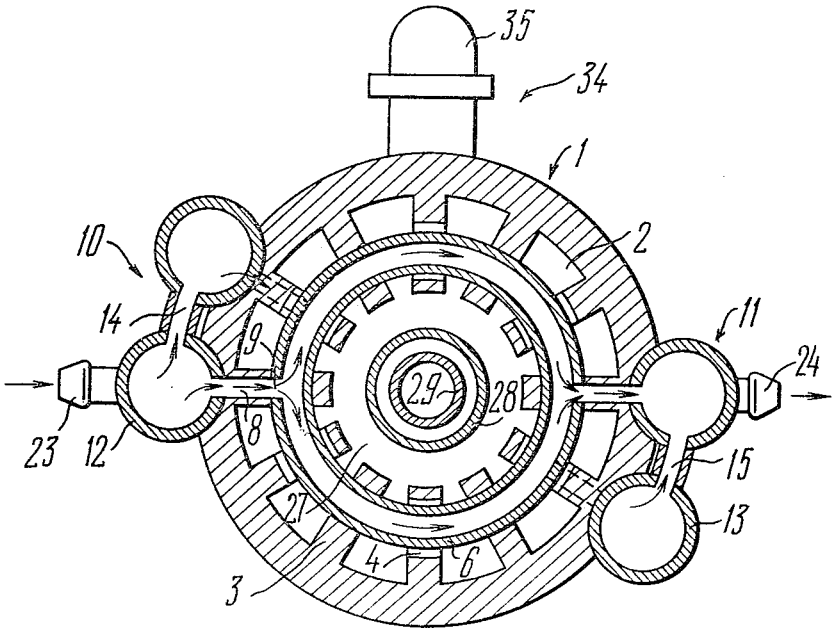
FIG. 2 is a section along the line II—II of FIG. 1, according to the invention.

The chambers 10, 11 are implemented in the form of tubes 12, 13, respectively. The tubes 12 of the chamber 10 are coupled rigidly and hermetically to the anode block 1 and connect one another via a duct 14 (FIG. 2). The tubes 13 are of the chamber 11 are coupled rigidly and hermetically to the anode block 1 and connect one another via a duct 15. The tubes 12, 13 are located along the axis of the anode block 1 and the length of the chambers 10, 11 formed by these tubes, as measured along the axis of the anode block 1 (FIG. 1), is equal to at least a space between two outermost radially extending channels 8 communicating with respective chambers 10, 11.

To further decrease the hydrodynamic resistance of the cooling channels, it is feasible to increase the number of radially extending channels communicating with respective ring-like tubes; this means that the radially extending channels can be made in six, eight and more vanes, an even number of the latter being preferable. It is allowable to connect the additional radially extending channels to both the coolant distribution and the coolant collection chamber.

There is a hydraulic coupling between the chambers 10, 11. FIG. 1 shows a modification of such hydraulic coupling which is attained by virtue of an external hydrodynamic system dealing with a forced cooling of the anode block 1. This system delivers a liquid coolant (for example, water, antifreeze, ethyleneglycol) by means of a circulation pump 16. The system also comprises a vessel 17 with a liquid coolant, which communicates with the pump 16 via a valve 18. The pump 16 is connected, via a valve 19, to a filter 20. The latter is connected, via a valve 21 and a hermetically sealed connector 22, with an input nozzle 23 of the magnetron, which communicates with the coolant distribution chamber, 10. An output nozzle 24 of the magnetron, communicating with the coolant collection chamber 11, is coupled with the vessel 17 via a hermetically sealed connector 25 and a heat exchanger 26.

Due to small hydrodynamic resistance of the cooling channels of the magnetron, use may be made of another modification of the forced cooling hydrodynamic system in which the input nozzle is coupled directly with the water pipe system, while the output nozzle provides for free discharge of the coolant.

Figure 3:
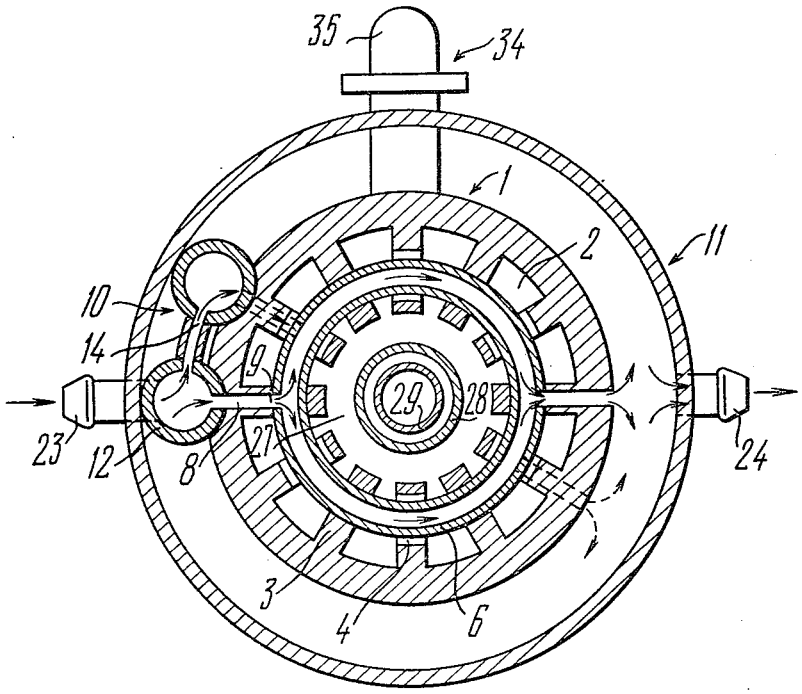
FIG. 3 is a variant of the device of the invention with a liquid coolant collection chamber which surrounds the anode block and a liquid coolant distribution chamber (lateral section), according to the invention.

To provide for more effective cooling of the anode block 1, including its internal heat-loaded elements, the vanes 3 and straps 6, 7, and its peripheral portion as well, it is good practice to arrange one of the chambers 10, 11 in axial relation to the anode block 1 and to allow that chamber to surround the anode block 1 and the other chamber. FIG. 3 shows the coolant distribution chamber 10 similar to that of FIG. 1, and the coolant collection chamber 11 made in the form of a hermetically sealed casing.

The resonance retardation system of the anode block 1 (FIG. 1) utilizes the vanes 3 of the resonators 2 to form an anode hole 27. Arranged within the latter in axial relation to it is a cathode 28 with a heater 29. They are coaxial metallic tubes made of heat-resisting materials and the material of the cathode 28 has emission properties. The cathode 28 with the heater 29 are affixed to the anode block 1, in axial relation to the anode hole 27, by means of vacuum-type metallic-ceramic insulators 30, 31 (cathode lugs), which comprise terminals 32, 33 providing connections to power supplies $U_h$ and $U_a$ which produce, respectively, filament current for the heater 29 and anode voltage. The anode block 1, held at the positive potential $U_a$, is grounded, while the cathode 28 is coupled to the minus side of the power supply $U_a$.

An output means 34 (FIG. 2), adapted for output microwave power and having an output dielectric window 35, is coupled electrically to the resonators 2 of the anode block 1 using a conventional means such as a coupling loop, a conductive coupling element, a slot-type coupling means or the like (not shown).

The device of the invention operates in the following manner. The cathode 28 (FIG. 1), located in the middle of the anode hole 27, is heated to the required temperature by means of the heater 29 connected to the power supply $U_h$. The electrons emitted by the cathode 28 are accelerated by an electric field established by the power supply $U_a$ between the anode, comprised of the end faces of the vanes 3 of the resonators 2, and the cathode 28.

In the presence of the magnetic field H (shown by an arrow if FIG. 1) directed along the axis of the anode block 1 the electrons, in the course of their movement to the anode, tend to excite r.f. oscillations in the resonators 2 of the retardation system of the anode block 1 via the gaps between the end faces of the vanes 3. The r.f. field produced within these gaps forms electron beams. Influenced by the applied anode voltage and the magnetic field H, the electron beams are moved along the anode surface in synchronism with the excited retarded electromagnetic wave, which is in its retardation phase, and transfer their energy, obtained from the power supply $U_a$, to a microwave electromagnetic field. The latter is accumulated in the resonators 2 of the retardation system of the anode block 1. The retardation system is held in a resonance state at that mode of oscillations whose frequency corresponds to a synchronous movement of the flow of electrons interacting with the electromagnetic wave of the mode.

The device of the invention shown in FIG. 1 operates in the continuous generation or the pulsed mode, at the frequency corresponding to the longest $\pi$-mode of oscillations. It is also possible to operate the device in the amplification mode by using an external synchronization signal.

When moving towards the anode and transferring their energy to the microwave electromagnetic field, the electrons fall onto the anode formed by the end faces of the vanes 3. Since these electrons yet have some amount of the remaining kinetic energy, it is transformed to thermal energy during the collision of the electrons and the vanes 3. First, the end faces of the vanes 3 are heated and the flow of heat is then transferred over the total length of the vanes 3. In addition, r.f. currents induced in the resonators 2 tend to heat their current-carrying walls due to ohmic loss in the skin of the walls.

Subject to the effect of heat are the straps 6, 7 maintained in the microwave electromagnetic field of the resonators 2.

The cathode 28, heated to high temperature, tends to heat the adjacent surfaces of the anode block 1.

There result local heat overloads during operation, in the case of electric breakdown between the anode and cathode 28, in a condition when the total energy provided by the power supply $U_a$ is evolved in the form of heat within a small area on the surface of these electrodes. There also result r.f. breakdowns and a secondary electron discharge between the straps 6, 7 and the vanes 3.

The total heat evolved at the working surfaces of the anode, including the vanes 3, straps 6, 7, current-carrying walls of the resonators 2 and the like, is removed by means of the liquid coolant which is moved through the cooling system of the anode block 1 by means of the circulation pump 16 (or by a water pipe system). After entering the input nozzle 23, the coolant passes into the coolant distribution chamber 10 made of two tubes 12. The latter communicate with each other via the ducts 14 (FIG. 2) and are located on the anode block 1 along its axis. Therefore, the liquid coolant, when passing through the tubes 12, is used to cool down the peripheral portion of the anode block 1. After leaving each of the tubes 12, the flow of the liquid coolant passes to the radially extending channels 8 (as shown by respective arrows ) which are implemented in the adjacent vanes 3 arranged in pairs and are coupled by one side to the coolant distribution chamber 10, and by the other side to the ring-like tubes, i.e., respective straps pairs 5 of the straps 6, 7. In the given embodiment, the ring-like tubes perform the function of cooling channels and also serve as the straps 6, 7 (FIG. 1) coupled to respective vanes 3 of the resonators 2.

Since the ring-like tubes are held in thermal contact with the vanes 3, all they are subject to cooling.

The device of the invention is therefore advantageous in that the peripheral portion of the anode block 1, resonators 2, vanes 3 and straps 6, 7 are subject to concurrent cooling and that the well-branched cooling system in the anode block 1 has a small hydrodynamic resistance. The flow of the liquid coolant, leaving the chamber 10, is divided into a number of parallel flows which pass through the radially extending channels 8 of the vanes 3 and then the strap pairs 5 of the straps 6, 7 implemented as ring-like tubes, the latter being arranged in height of the anode block 1 along its axis. This provides for a maximal cooling surface for the anode block 1 as a whole and its heat-loaded areas are therefore subject to effective cooling.

The device of the invention is also advantageous in that the flow of the liquid coolant, passing through the holes 9 in the straps 6, 7, is divided into two or more flows which are led over the straps 6, 7 and vanes 3. In addition to an extra reduction of the hydrodynamic resistance, with such distribution of the flow, the movement of the coolant within the strap (6 or 7) itself over the circumference of the ring-like tube improves the conditions under which the flow is made turbulent, which provides for more intensive heat exchange, as compared to laminar movement. The test results show that the cooling of the straps 6, 7 with a flow of a liquid coolant directed laterally with respect to the active body (the strap) in accordance with the given embodiment of the invention provides for better generating hydrodynamic characteristics, as compared to the known methods of cooling the vanes in which the coolant moves over the vane (tube) longitudinally, with identical coolant temperatures and power outputs.

Another advantage of the device of the invention is that the cooling channels in the straps 6, 7 are protected by the end faces of the vanes 3 from electron bombardment and from electric breakdown in the anode-cathode space, and are not subject to high electric loads. The independent parallel connection of the cooling channels of each of the straps 6, 7 to the coolant distribution chamber 10 allows for the operative condition of the device even if one or more channels in any of the straps 6, 7 becomes clogged, as the remaining channels are maintained operative until the trouble is remedied. Therefore, the reliability of the device of the invention is increased.

The flow of the coolant passed through the cooling channels of the straps 6, 7 is led through the output radially extending channels 8 which communicate with the channels of the straps 6, 7 and are implemented in two adjacent vanes 3 of the resonators 2, said vanes 3 being located in opposition to two other vanes 3 on the side of the coolant distribution chamber 10.

The output radially extending channels 8 may be implemented in two or more vanes 3, as shown in FIG. 1. The flow of the liquid coolant from the channels 8 is collected in the chamber 11 comprised of two tubes 13 which are interconnected with the duct 15 (FIG. 2) and connect the channels 8.

The chamber 11 or 10 (FIG. 3) may be made in the form of a hermetically sealed cylindrical casing which is located in axial relation to the anode block 1 and surrounds it and the other chamber, with the result that the anode block 1 can be cooled more effectively in its peripheral portion.

The flow of the liquid coolant, heated by hot working surfaces of the anode block 1, goes out of the chamber 11 and passes via the output nozzle 24 (FIG. 1), and, by means of the pump 16, to the heat exchanger 26 or is discharged freely.

In the device of the invention, the well-branched system of cooling channels, which are available on the periphery of the anode unit 1, on the straps 6, 7 and on the vanes 3, provides for effective cooling of the heat-loaded working surfaces of the anode block 1, especially in the case of a multistage two-dimensional periodic retardation system of great axial size (with the height of the anode block exceeding $\lambda/2$). This provides for an increase in the power output in both the continuous mode and the pulsed mode of operation.

Therefore, the device of the invention has a cooling system with channels of small hydrodynamic resistance and great cooling surface. Thus, the anode block is cooled more effectively and the reliability of the cooling system and the device itself is increased. This allows for a maximum permissible increase in the continuous or average microwave power output at a considerably low pressure drop referred to the input and the output of the cooling system.

What is claimed is:

1. A high power liquid cooled double strapped vane type magnetron, comprising:

a generally cylindrical anode block having a plurality of circumferentially disposed evacuated resonator cavities therein, with vanes separating adjacent cavities;

first and second hollow ring-like electrically conductive straps comprising strapping tubes traversing said cavities and electrically interconnecting alternate ones of said vanes, to form a first set of alternate vanes having like polarity at the $\pi$-mode of electromagnetic oscillation of said magnetron and a second set of alternate vanes having a given different polarity at said mode of oscillation;

said vanes having windows through which said straps extend, with each strap being thermally and electrically connected to the vanes of the corresponding set;

said vanes having a generally radial orientation, with a number of radially extending coolant flow channels corresponding to the number of said strapping tubes in at least two vanes of each set for communicating a coolant fluid into and out of the interior of the corresponding strap; and means for exciting and sustaining said electromagnetic oscillation.

2. The magnetron according to claim 1, further comprising axially extending coolant chambers communicating with at least one coolant flow channel of one of said sets of vanes, one of said chambers enclosing said anode block and another chamber.

* * * * *

UNITED STATES PATENT AND TRADEMARK OFFICE

CERTIFICATE OF CORRECTION

PATENT NO. : 4,274,032

DATED : June 16, 1981

INVENTOR(S) : Jury I. Dodonov, et al

It is certified that error appears in the above—identified patent and that said Letters Patent is hereby corrected as shown below:

In the Title: "MAGETRON" should be --MAGNETRON--.

Column 1, in the Title: "MAGETRON" should be --MAGNETRON--.

Column 1, line 13: delete "the".

Signed and Sealed this

*Seventh* Day of *December 1982*

[SEAL]

*Attest:*

GERALD J. MOSSINGHOFF

*Attesting Officer*

*Commissioner of Patents and Trademarks*